US008095043B2

(12) United States Patent
Matsuura

(10) Patent No.: US 8,095,043 B2
(45) Date of Patent: Jan. 10, 2012

(54) IMAGE FORMING APPARATUS AND METHOD OF ABRADING PHOTOCONDUCTOR OF THE APPARATUS

(75) Inventor: Kuniya Matsuura, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 749 days.

(21) Appl. No.: 12/073,445

(22) Filed: Mar. 5, 2008

(65) Prior Publication Data

US 2008/0220364 A1 Sep. 11, 2008

(30) Foreign Application Priority Data

Mar. 9, 2007 (JP) ..... 2007-059860

(51) Int. Cl.
*G03G 15/00* (2006.01)

(52) U.S. Cl. ..... 399/161; 399/38

(58) Field of Classification Search ..... 399/38, 399/161

See application file for complete search history.

(56) References Cited

U.S. PATENT DOCUMENTS

2006/0245782 A1* 11/2006 Hirai et al. ..... 399/101
2007/0065179 A1* 3/2007 Fujita ..... 399/175

FOREIGN PATENT DOCUMENTS

JP 08123215 A * 5/1996
JP 8-194419 A 7/1996
JP 9-244493 A 9/1997
JP 10074021 A * 3/1998
JP 11-212293 A 8/1999
JP 2000-155447 6/2000
JP 2000155447 A * 6/2000
JP 2003330321 A * 11/2003
JP 2005-300875 10/2005

OTHER PUBLICATIONS

Maching translation of JP-10074021.*
Machine translation of JP 2000155447.*
Machine translation JP 2003330321.*
Machine Translation of JP-2000-155447.*
Notification of Reason(s) for Refusal in JP 2007-059860 dated Mar. 24, 2009, and an English Translation thereof.

* cited by examiner

*Primary Examiner* — David Gray
*Assistant Examiner* — G. M. Hyder
(74) *Attorney, Agent, or Firm* — Buchanan Ingersoll & Rooney PC

(57) ABSTRACT

An image forming apparatus of the present invention is arranged to hold an intermediate transfer belt and a photoconductive drum out of contact with each other. In a non image formation process in a first mode, the intermediate transfer belt and the photoconductive drum are separated from each other upon completion of the image formation, thereby preventing contamination of the photoconductive drum due to back transfer. In a non image formation process in a second mode, the intermediate transfer belt and the photoconductive drum are separated from each other upon completion of the image formation, and then the intermediate transfer belt and the photoconductive drum are contacted with each other again upon completion of secondary transfer of an image. They are driven for a predetermined time with a speed difference therebetween, thereby abrading the surface of the photoconductive drum to refresh it.

19 Claims, 8 Drawing Sheets

FIRST MODE OF FIRST EXAMPLE

SECOND MODE OF FIRST EXAMPLE

FIRST MODE OF SECOND EXAMPLE

SECOND MODE OF SECOND EXAMPLE

IMAGE FORMING APPARATUS AND METHOD OF ABRADING PHOTOCONDUCTOR OF THE APPARATUS

CROSS-REFERENCE TO RELATED APPLICATIONS

This application is based upon and claims the benefit of priority from the prior Japanese Patent Application No. 2007-059860 filed on Mar. 9, 2007, the entire contents of which are incorporated herein by reference.

BACKGROUND OF THE INVENTION

1. Field of the Invention

The present invention relates to an electrophotographic image forming apparatus and, more particularly, to an image forming apparatus capable of preventing deterioration in image quality resulting from contamination of a photoconductor due to additive components to a developer, and a method of abrading the photoconductor.

2. Description of Related Art

As electrophotographic developers, heretofore, there are a two-component type developer containing toner and carrier and a single-component type developer containing no carrier. Many image forming apparatuses using such single-component type developer are provided with a friction member for helping frictional electrification of toner with no carrier. However, the charge uniformity of toner is not enough yet and thus an external additive is added to the toner to help to charge.

Recently, the flowability of toner tends to decrease because the toner has a reduced diameter for achieving high quality images in recent years, resulting in an increased specific surface area of the toner. Adding the external additive is also effective in covering the flowability decrease. As the external additive, inorganic compound particles are effective, and desiccated silica is often used. In addition, opposite-charging particles are added in order to enhance movability of toner in an electric field, thereby increasing efficiency of development and transfer. It should be noted that some of the two-component type developers also contain the external additive.

Furthermore, a cleaning member has conventionally been provided for cleaning the surface of a photoconductor. Due to the aforementioned diameter reduction of the toner, the toner is likely to slip or pass through the gap between the cleaning member and the photoconductor. The above external additive also serves as a measure to prevent the toner from slipping or passing through. To be specific, the external additive that leaves from the toner will be accumulated on an edge of the cleaning member, forming an external additive layer. This external additive layer can prevent the passage of the toner.

On the other hand, this may also cause the external additive components to condense and adhere as deposits to the surface of the photoconductor. The external additive components are likely to adhere to the photoconductor particularly under low temperature and low humidity environments. One of mechanisms that generate the above deposits has been known as back-transfer from an intermediate transfer body to the photoconductor. In other words, the external additive transferred onto the intermediate transfer body once will move by one turn of the intermediate transfer body to the transfer point again and transfer back to the photoconductor. Such external additive on the intermediate transfer body has passed or slipped through a secondary transfer point and a cleaning member for the intermediate transfer body and, in many cases, condensed or coagulated on the intermediate transfer body. Thus, the external additive is apt to form deposits.

Even the external additive that has not been transferred forth and back yet, i.e., that remains on the photoconductor, may pass or slip through the cleaning member for the photoconductor and turn along with the photoconductor. Such external additive will fixedly adhere to the photoconductor by electric discharge when it passes through a charging section. Also, charge level of the external additive will change at that time. In the case where the developer containing the opposite-charged particles is used, accordingly, the opposite-charged particles may be attracted by the remaining external additive at the transfer point or the like, resulting in formation of large deposits. This would lead to the occurrence of visible image noises.

JP11(1999)-212293A discloses that an abrasive is added as an external additive in the developer. This abrasive helps to remove the deposits by abrading the surface of the photoconductor while the cleaning member scrapes the toner remaining after transfer. As other techniques, for example, JP9 (1997)-244493A discloses that an abrading member is provided in addition to a cleaning member and JP8(1996)-194419A discloses that an abrasive is supplied to a cleaning member.

SUMMARY OF THE INVENTION

However, the aforementioned conventional techniques have the following disadvantages. The cleaning member can not fully remove the deposits from the photoconductor. After long use, therefore, the unremoved deposits will accumulate on the photoconductor and further increase in size, leading to image noises. A certain amount of deposits could be removed in the transfer section; however, the deposits may pass through the cleaning in a transfer destination and adhere again to the photoconductor as mentioned above.

When a speed difference is given between the photoconductor and the transfer body, removal of the deposits can be facilitated in the transfer section. However, a larger speed difference may deteriorate image quality. Increasing the amount of abrasive added in the developer will cause problems such as in-apparatus contamination and toner charging failure. Adding the abrading member will increase the complexity and size of the apparatus. The same applies to an apparatus configured to supply the abrasive to the cleaning member.

The present invention has been made in view of the above circumstances and has an object to provide an image forming apparatus and a method of abrading a photoconductor of the apparatus to allow appropriate refreshing of the photoconductor without excessively abrading the photoconductor to maintain good image quality over a long period.

To achieve the purpose of the invention, there is provided an image forming apparatus comprising a photoconductor, a toner image forming section for forming a toner image on the photoconductor, a contact member that is switchable between a contact state and a separate state with respect to the photoconductor so that the contact member contacts with the photoconductor during image formation period, and a non-image-formation-period control section that performs control to prevent contamination of a surface of the photoconductor during non image formation period, and is arranged to perform one of a first mode and a second mode, wherein the first mode being configured to hold the photoconductor and the contact member separate from each other during the non image formation period, and the second mode being configured to, during the non image formation period, perform an abrasion process for a predetermined time by rotating the photoconductor with a larger speed difference between the photoconductor and the contact member than that of the image formation period, while the photoconductor and the contact member are held in contact with each other, and hold the photoconductor and the contact member separate from each other for a period other than the abrasion process.

In the image forming apparatus of the present invention, accordingly, during non image formation period, either the first mode or the second mode is executed. In the first mode, the photoconductor and the contact member are held out of contact with each other to prevent back transfer of deposit matters from the contact member to the photoconductor. In the second mode, the abrasion process is performed within a predetermined time to remove the deposit matters from the photoconductor. Accordingly, the photoconductor can be refreshed and thus the image quality can be maintained.

According to another aspect, the present invention provides an image forming apparatus comprising a photoconductor, a toner image forming section for forming a toner image on the photoconductor, a contact charging member for charging the photoconductor while contacting the photoconductor during image formation period, and a non-image-formation-period control section that performs control to prevent contamination of a surface of the photoconductor during non image formation period, and is arranged to, during non image formation period, perform an abrasion process for a predetermined time by rotating the photoconductor with a larger speed difference between the photoconductor and the contact charging member than that of the image formation period, while the photoconductor and the contact member are held in contact with each other. With this configuration also, there is no need for providing any special contact member.

According to another aspect, the present invention provides a method of abrading a photoconductor of an image forming apparatus that comprises a photoconductor, a toner image forming section for forming a toner image on the photoconductor, and a contact member that is switchable between a contact state and a separate state relative to the photoconductor so that the contact member contacts with the photoconductor during image formation period, the method including the steps during non image formation period of: performing an abrasion process for a predetermined time by rotating the photoconductor with a larger speed difference between the photoconductor and the contact member than that of the image formation period, with holding the photoconductor and the contact member in contact with each other, and holding the photoconductor and the contact member separate from each other for a period other than the abrasion process.

According to another aspect, furthermore, the present invention provides a method of abrading a photoconductor of an image forming apparatus that comprises a photoconductor, a toner image forming section for forming a toner image on the photoconductor, and a contact charging member for charging the photoconductor while contacting the photoconductor during image formation period, wherein during non image formation period, an abrasion process is performed for a predetermined time by rotating the photoconductor with a larger speed difference between the photoconductor and the contact charging member than that of the image formation period, with holding the photoconductor and the contact member in contact with each other.

According to the above configurations, the present invention can provide the image forming apparatus and the method of abrading the photoconductor, capable of refreshing the photoconductor appropriately without excessive abrasion thereof and maintaining good image quality for a long term.

DETAILED DESCRIPTION OF THE PREFERRED EMBODIMENTS

Figure 1:
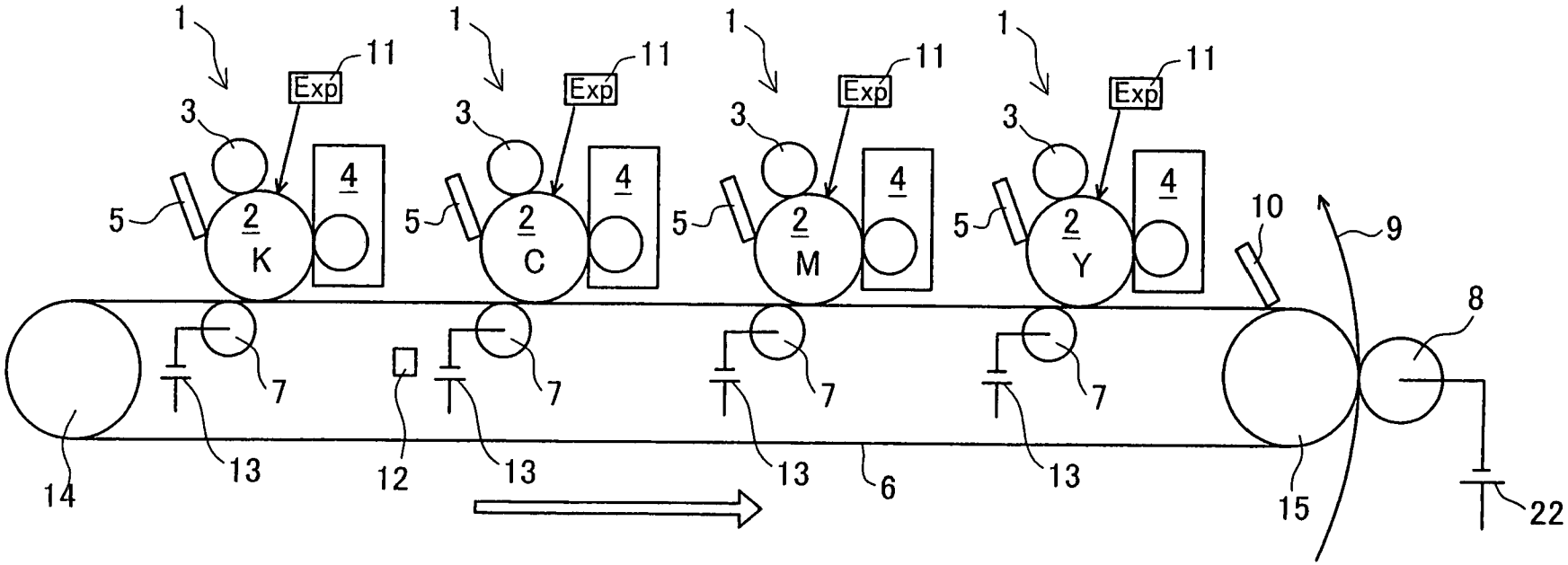
FIG. 1 is a sectional view of an entire configuration of an image forming apparatus in a preferred embodiment.

A detailed description of a preferred embodiment of the present invention will now be given referring to the accompanying drawings. In the present embodiment, the present invention is applied to a tandem, four-color image forming apparatus. FIG. 1 shows the entire configuration of the image forming apparatus in the present embodiment.

The image forming apparatus in the present embodiment shown in FIG. 1 includes four image forming units 1. Each unit 1 is configured to form an image in one of four colors; Yellow (Y), Magenta (M), Cyan (C), and Black (K). The image forming apparatus in the present embodiment further includes an intermediate transfer belt 6 that is wound over rollers 14 and 15 to travel counterclockwise in FIG. 1. The four image forming units 1 are placed above the intermediate transfer belt 6 in FIG. 1.

The image forming apparatus in the present embodiment further includes a secondary transfer roller 8, a cleaning blade 10, and an environment sensor 12. The secondary transfer roller 8 is a roller for transferring toner images from the intermediate transfer belt 6 to a tangible recording medium 9 such as a print sheet. The secondary transfer roller 8 is therefore provided with a bias supply 22. The tangible recording medium 9 is later subjected to a process for fixing toner images. The cleaning blade 10 serves to scrape and collect residual toner from the intermediate transfer belt 6 after transfer, as waste toner. The environment sensor 12 is used to detect temperature and humidity in the apparatus.

Each image forming unit 1 has a photoconductive drum 2. With the photoconductive drum 2, the intermediate transfer belt 6 is in contact. Around the photoconductive drum 2, there are placed a charge roller 3, an exposure device 11, a developing device 4, a primary transfer roller 7, and a cleaning blade 5.

The charge roller 3 is held in contact with the photoconductive drum 2 to uniformly charge the surface of the drum 2. The exposure device 11 operates to form a latent image on the surface of the photoconductive drum 2 based on image data. The developing device 4 operates to form a toner image on the latent image on the surface of the photoconductive drum 2. The primary transfer roller 7 is placed opposite the photoconductive drum 2 relative to the intermediate transfer belt 6 and operates to transfer the toner image from the photoconductive drum 2 to the intermediate transfer belt 6. The primary transfer roller 7 is therefore provided with a bias supply 13. The cleaning blade 5 is used to scrape and collect residual toner from the photoconductive drum 2 after transfer, as waste toner.

Figure 2:
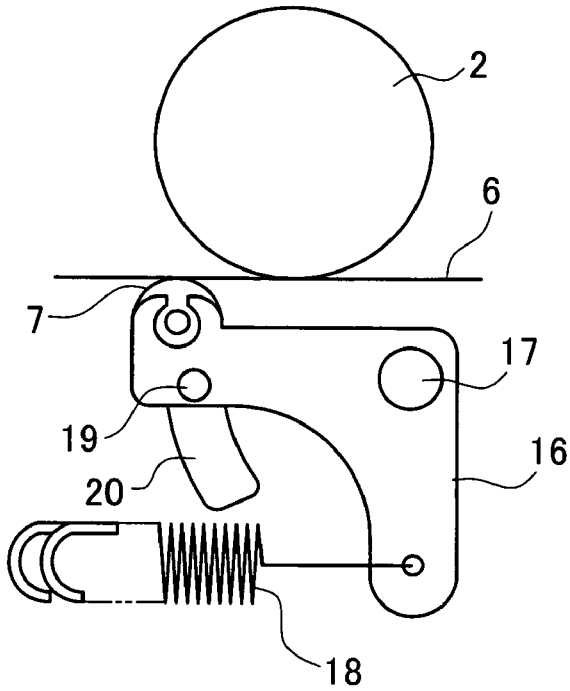
FIG. 2 is an explanatory view for a separating mechanism of a primary transfer roller in the image forming apparatus in the preferred embodiment.

As shown in FIG. 2, the primary transfer roller 7 in the present embodiment is configured to be movable upward and downward in the figure relative to the photoconductive drum 2 and the intermediate transfer belt 6. Specifically, a lever member 16 holding the shaft of the primary transfer roller 7 is placed opposite the photoconductive drum 2 relative to the intermediate transfer belt 6. The lever member 16 is pivoted on a shaft 17. The lever member 16 has a pin 19. A frame of the apparatus is formed with a curved slot 20 in which the pin 19 is slidably engaged. This slot 20 limits a rotatable range of the lever member 16.

Figure 3:
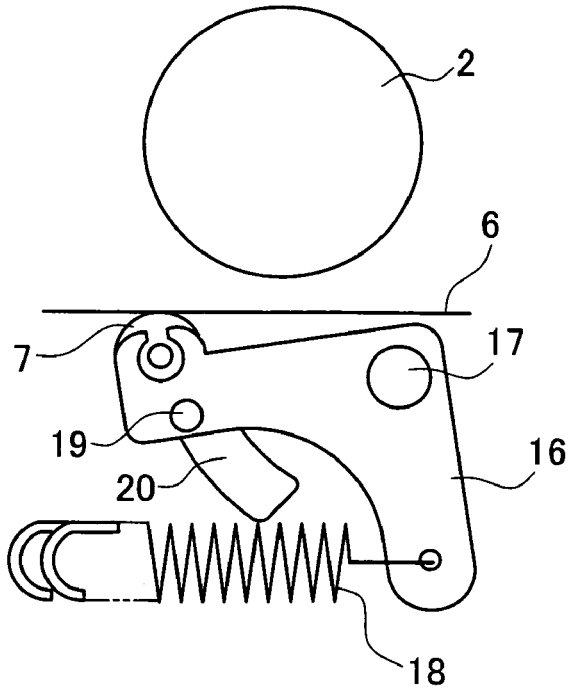
FIG. 3 is another explanatory view for the separating mechanism of the primary transfer roller in the image forming apparatus in the preferred embodiment.

Furthermore, a spring 18 is provided to urge the lever member 16 clockwise in FIG. 2. In other words, the primary transfer roller 7 is pressed against the intermediate transfer belt 6 by the elastic force of the spring 18. Accordingly, the intermediate transfer belt 6 is pressed against the photoconductive drum 2. When the lever member 16 is rotated counterclockwise in the figure, the intermediate transfer belt 6 is separated from the photoconductive drum 2 as shown in FIG. 3. It is to be noted that the degree of contact pressure of the intermediate transfer belt 6 against the photoconductive drum 2 can be changed by fine movements of the lever member 16 while the contact state shown in FIG. 2 is maintained.

Figure 4:
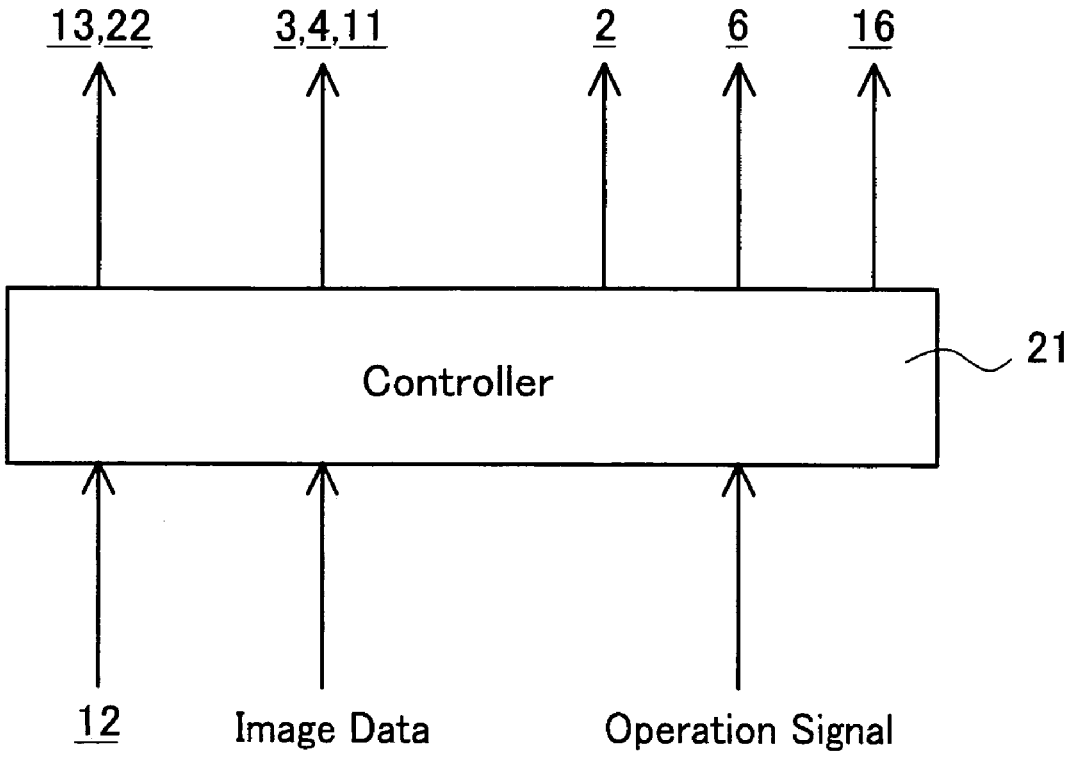
FIG. 4 is a block diagram showing a configuration of a control system of the image forming apparatus in the preferred embodiment.

FIG. 4 is a block diagram showing a configuration of a control system of the image forming apparatus in the present embodiment. The control system of the image forming apparatus in the present embodiment is arranged centering on a controller 21. To be more specific, the controller 21 operates to execute various controls including transfer bias control of the bias supplies 13 and 22, common image forming control of the charge roller 3, the exposure device 11, and the developing device 4, speed control of the photoconductive drum 2 and the intermediate transfer belt 6, contact/separate control of the lever member 16 for bringing the intermediate transfer belt 6 into/out of contact with the photoconductive drum 2, and others. The controller 21 is accordingly arranged to receive an acquired value by the environment sensor 12, image data, an operation signal input by a user, and others.

Of the aforementioned various controls, the speed control of the photoconductive drum 2 and the intermediate transfer belt 6 is executed by controlling a rotation drive unit such as a motor coupled to each rotary shaft of the drum 2 and the belt 6. The control of the lever member 16 is executed by controlling an actuator such as a motor or a solenoid coupled to the lever member 16.

Operations of the image forming apparatus in the present embodiment will be described below. The image forming operations of the image forming apparatus in the present embodiment are mostly common and thus the following explanation will be made with a focus on distinctive parts. The operations of the image forming apparatus in the present embodiment are characterized in a measure against the generation of deposits on the photoconductive drum 2. The mechanism that generates the deposits on the surface of the photoconductive drum 2 is as explained in the aforementioned background section.

This measure against deposits basically includes preventing retransfer of a coagulated matter from the intermediate transfer belt 6 to the photoconductive drum 2 and abrading the surface of the photoconductive drum 2 to remove the coagulated matter, both measures being carried out during non-image-formation. Accordingly, the image forming apparatus in the present embodiment is adapted to perform two control modes for the non-image formation; namely, a first mode and a second mode. The non-image-formation period corresponds to an interval between the end of a print job and the start of a next print job, an interval between the end of a page and the start of a next page within a print job, and so on.

FIRST EXAMPLE

Figure 5:
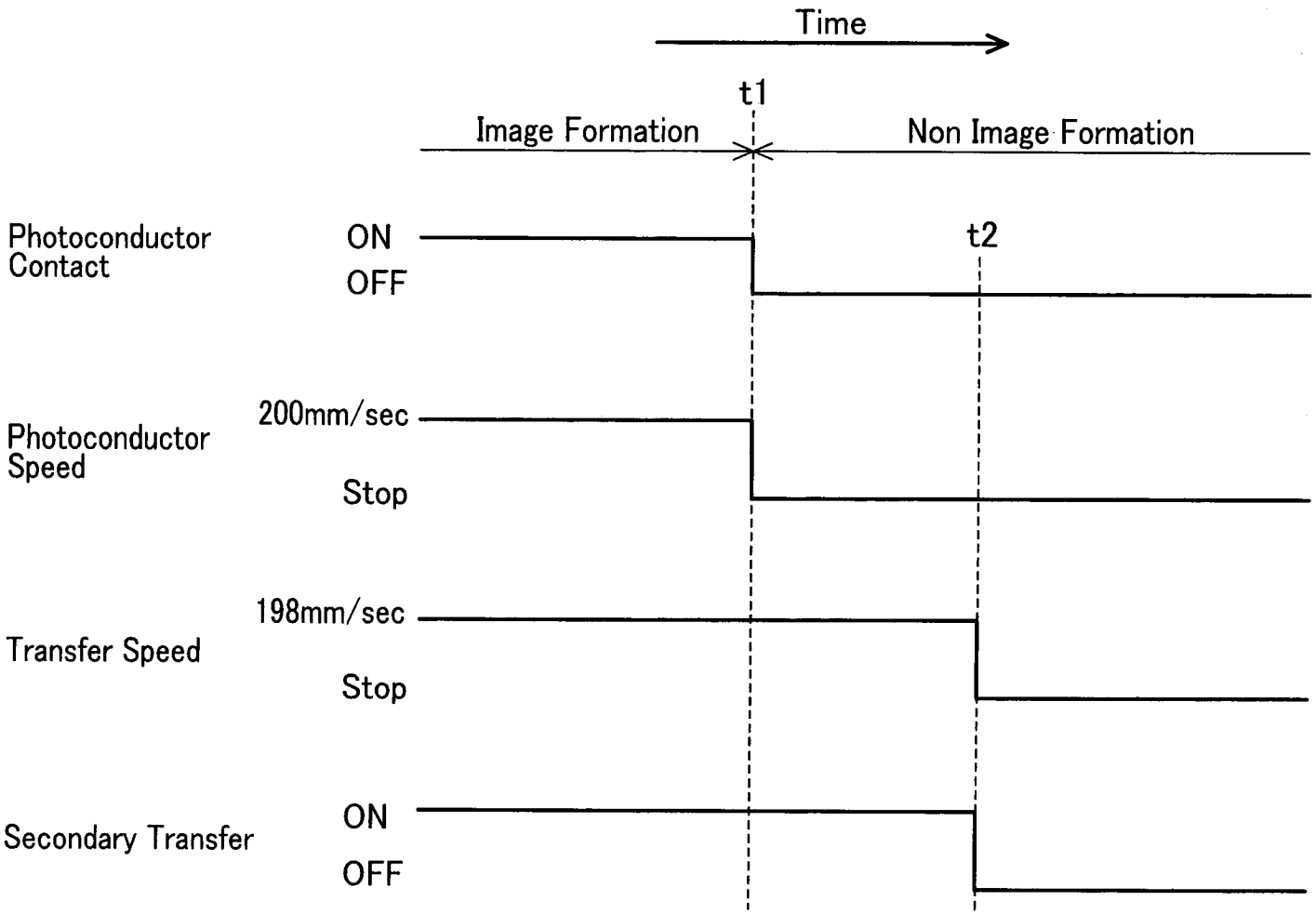
FIG. 5 is a timing chart showing control in a first mode of a first example after the end of image formation.

A first mode of a first example is explained below. In the first mode, each image forming unit 1 is controlled according to a timing chart shown in FIG. 5 after completion of image formation. In FIG. 5, a term "Photoconductor Contact" indicates a contact or separate condition between the photoconductive drum 2 and the intermediate transfer belt 6. "ON" represents a contact state (a state in FIG. 2) and "OFF" represents a separate state (a state in FIG. 3). This switching is of course based on movement of the aforementioned lever member 16.

A term "Photoconductor Speed" in FIG. 5 indicates the circumferential speed of the photoconductive drum 2 during rotation. A term "Transfer Speed" indicates the traveling speed of the intermediate transfer belt 6. A term "Secondary Transfer" indicates an ON/OFF state of bias voltage to the secondary transfer roller 8. Each of those parameters is also applied to timing charts shown in FIG. 6 and subsequent figures. As shown in FIG. 5, there is a slight speed difference between the photoconductive drum 2 and the intermediate transfer belt 6 even during image formation. This is usually conducted to ensure image quality.

During image formation, obviously, "Photoconductor Contact" is ON and both the photoconductive drum 2 and the intermediate transfer belt 6 operate at respective normal speeds. Needless to say, the secondary transfer bias is also ON. Upon completion of the image formation at time t1, "Photoconductor Contact" is turned OFF. To be specific, the lever member 16 is operated to separate the intermediate transfer belt 6 from the photoconductive drum 2 to a position shown in FIG. 3. Simultaneously, the rotation of the photoconductive drum 2 is stopped because the toner image no longer needs to be transferred from the photoconductive drum 2 to the intermediate transfer belt 6. Further, separation of the intermediate transfer belt 6 from the photoconductive drum 2 can prevent the toner from transferring back from the intermediate transfer belt 6 to the photoconductive drum 2. In view of preventing contamination of the photoconductive drum 2 due to back transfer, specifically, they should be separated from each other for a period other than the image formation.

Travel of the intermediate transfer belt 6 is not stopped at time t1 because the secondary transfer to the tangible recording medium 9 has not yet been completed. After the intermediate transfer belt 6 further travels, the secondary transfer of the toner image is completed at time t2. So, the intermediate transfer belt 6 is stopped at time t2 and simultaneously the secondary transfer bias, which is no longer necessary, is turned OFF. As above, all of "Photoconductor Contact", "Photoconductor Speed", "Transfer Speed", and "Secondary Transfer" are turned OFF and maintain the state until the start of next image formation. The first mode is a Separation mode in which the photoconductive drum 2 and the intermediate transfer belt 6 are held in non-contact relation during the non-image-formation.

Here, time t1 corresponds to the end of image formation in each of the image forming units 1. Time t1 therefore varies from one image forming unit 1 to another so that time t1 in the image forming unit placed at an upper stream position (a right side in FIG. 1) is earlier. On the other hand, time t2 is common to all the image forming units 1. In FIG. 5, the rotation of the photoconductive drum 2 may be continued after time t1 until untransferred residual toner are collected by the cleaning blade 5. Similarly, the traveling of the intermediate transfer belt 6 may be continued after time t2 until untransferred residual toner are collected by the cleaning blade 10. The above operations are the process in the first mode to be performed after the end of the image formation.

Figure 6:
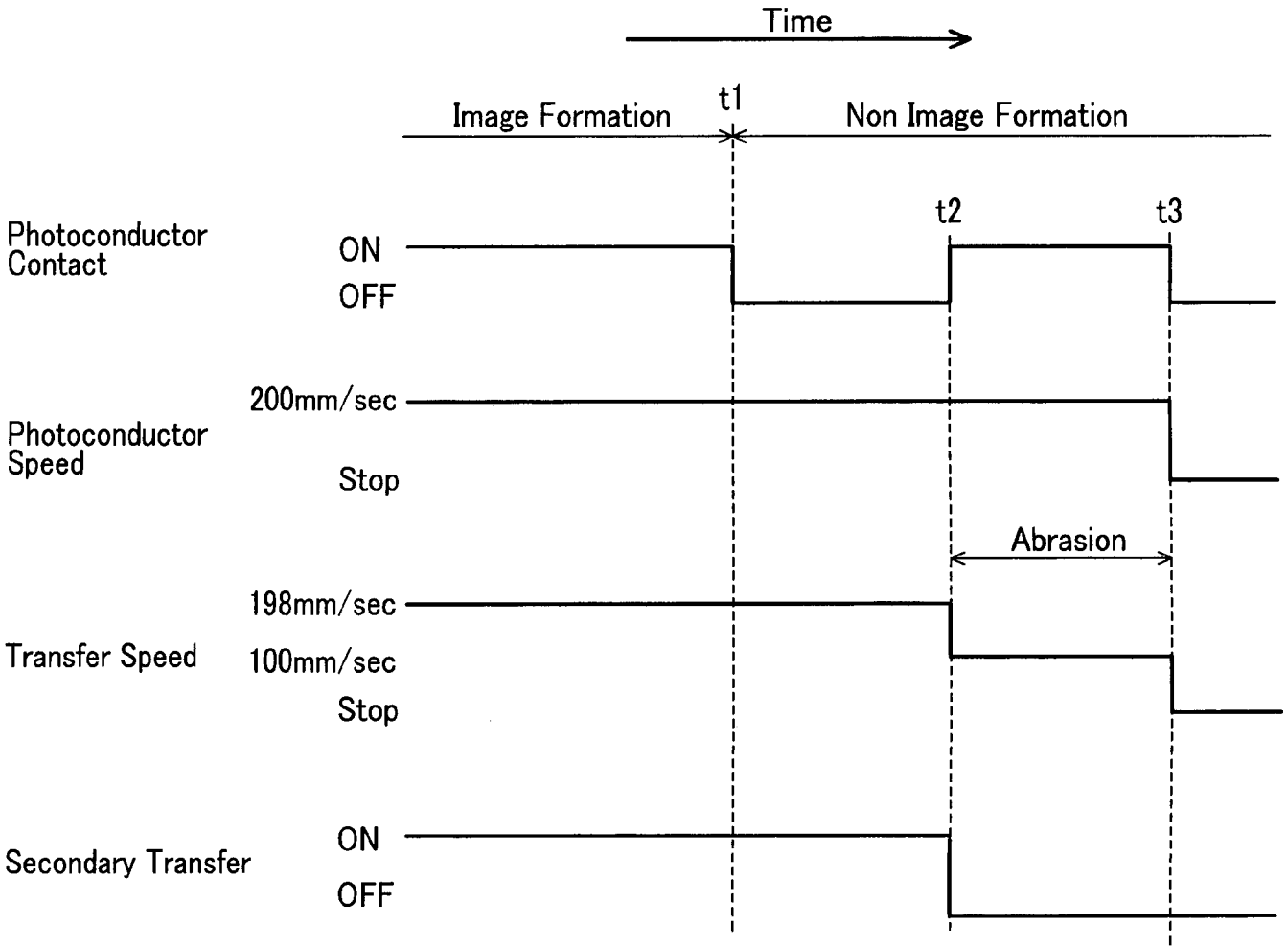
FIG. 6 is a timing chart showing control in a second mode of the first example after the end of image formation.

A second mode of the first example will be explained below. In the second mode, each image forming unit 1 is controlled based on the timing chart shown in FIG. 6 after completion of image formation. The operations during image formation in the case of FIG. 6 are the same as those in the case of FIG. 5 showing the first mode. Upon completion of the image formation at time t1, "Photoconductor Contact" is turned OFF. This also is the same as in the first mode. However, the photoconductive drum 2 is not stopped at time t1 and continues to rotate at "Photoconductor Speed" equal to that during the image formation. At time t1, "Transfer Speed" and "Secondary Transfer" of course remain unchanged from those during the image formation.

Upon completion of the secondary transfer at time t2, "Photoconductor Contact" is turned ON again. Simultaneously, "Transfer Speed" is reduced to about half the previous speed during the image formation. "Photoconductor Speed" remains unchanged. "Secondary Transfer" is turned OFF at this time as in the first mode. At time t3 after a lapse of a predetermined time from time t2, "Photoconductor Contact", "Photoconductor Speed", and "Transfer Speed" are turned OFF.

In the second mode, specifically, the photoconductive drum 2 is rotated at a different speed from that of the intermediate transfer belt 6 within a predetermined time from the end of secondary transfer. The speed difference is much larger than a speed difference provided during the image formation. During this period, accordingly, the surface of the photoconductive drum 2 is abraded, thereby removing or peeling deposits from the surface of the photoconductive drum 2. Part of the removed deposits is carried by the intermediate transfer belt 6 and collected by the cleaning blade 10. Residual deposits are left on the photoconductive drum 2 but will be collected by the cleaning blade 5. The surface of the photoconductive drum 2 is refreshed as above to enhance the quality of image to be formed subsequently. In short, the second mode is an Abrasion mode in which the surface of the photoconductive drum 2 is abraded during the non-image-formation period.

While this abrasion is in action, the photoconductive drum 2 is rotated. Thus, not only one portion of the surface of the drum 2 but also the entire surface thereof will be abraded. The intermediate transfer belt 6 is also driven to travel during the abrasion period. Abrasion stress therefore will not be applied to only one point of the belt 6. Further, "Photoconductor Contact" is turned OFF during the non-image-formation period excepting the abrasion period. During this OFF period, as with the case of the first mode, back transfer from the intermediate transfer belt 6 to the photoconductive drum 2 is prevented.

In the present example, the abrasion period is set after time t2, not right after time t1, to prevent the quality of an image formed just before time t1 from being damaged by the abrasion process. In other words, since the toner image still remains on the intermediate transfer belt 6 during a period from time t1 to time t2, the traveling speed of the intermediate transfer belt 6 should not be changed or excess stress should not be applied on the intermediate transfer belt 6 during such period. The abrasion process performed after time t2 will cause no problem. The interval from time t2 to time t3, namely, the time of an abrasion process can be determined as for example the number of rotations of the photoconductive drum 2. The untransferred toner remaining on the intermediate transfer belt 6 at time t2 is collected by the cleaning blade 10 up to time t3.

In the above second mode, the speed of the intermediate transfer belt 6 is reduced than that during the image formation as shown in FIG. 6 to provide a speed difference for the abrasion period. However, the speed difference may be produced by other ways. One alternative is to produce the speed difference by reducing the rotation speed of the photoconductive drum 2. Another alternative is to produce the speed difference by increasing the rotation speed of either the belt 6 or the drum 2 instead of reducing it. During the abrasion period, contact pressure of the intermediate transfer belt 6 against the photoconductive drum 2 may be adjusted to be larger than that during the image formation. This adjustment can provide higher abrasion effect. Even if "Photoconductor Contact" remains ON from time t1 to time t2 in FIG. 6, there is no large difference in the effect.

In FIG. 6, furthermore, the abrasion period is set at an early stage of the non-image-formation period. As an alternative, the abrasion period may be set at any stage within the non-image-formation period. However, it is more effective to set the abrasion time at the early stage of the non-image-formation period as shown in FIG. 6 because a next image formation operation can be started immediately.

The following description is made on how to selectively use the first mode and the second mode. The process in the second mode after the end of image formation does not need to be performed very frequently. Accordingly, it may be arranged such that the first mode is normally performed and the second mode is conducted at an appropriate frequency. For instance, it may be arranged such that the number of printed sheets or the amount of toner consumption is counted, and the second mode is performed when the count reaches a predetermined value. More specifically, the second mode may be conducted after every one hundred sheets in the case of the number of printed sheets or after every consumption of one gram in the case of the amount of toner consumption. As an alternative, the second mode may be performed just after a predetermined event or matter such as power-on of the image forming apparatus, return from a power-saving mode, recovery from jamming, and restart after cover opening and closing operations. The above selective use of the modes can prevent excess abrasion of the photoconductive drum 2 as compared with the case where the second mode is performed every time.

Further, the time of the abrasion process in the second mode may be set to be longer as the length of use of the photoconductive drum 2 becomes longer. This is because deposits are more likely to occur as the photoconductive drum 2 is used longer. Assuming that the total length of lifetime of the photoconductive drum 2 is 60 hours, for example, the abrasion time is determined as follows.

(i) Up to 20 hours of use from the start of use:
Two rotations of the photoconductive drum 2;
(ii) Up to 40 hours of use after the lapse of 20 hours of use:
Four rotations of the photoconductive drum 2; and (iii) Up to the end of lifetime after the lapse of 40 hours of use:

Six rotations of the photoconductive drum 2.

In addition, the detected value of the environment sensor 12 can be reflected in the second mode. The deposits are likely to occur on the photoconductive drum 2 under a low temperature or a low humidity environment as compared with under a high temperature or a high humidity environment. Accordingly, the time of the abrasion process in the second mode may be set to be longer under the low temperature or low humidity environment as compared with under the high temperature or high humidity environment. For instance, the abrasion time can be determined according to the environmental conditions by adding the following additional rotation(s) of the photoconductive drum 2 to the above set abrasion time (i), (ii), or (iii). In the case of considering only one of the temperature and the humidity, the other may be disregarded. In the case of considering both of them, a longer one of the abrasion times set for respective conditions below is selected.

(a) Temperature of 15° C. or low or Humidity of 20% or low:

Additional two rotations of the photoconductive drum 2;

(b) Temperature of 15° C. to 25° C. or Humidity of 20% to 60%:

Additional one rotation of the photoconductive drum 2; and (c) Temperature of 25° C. or higher or Humidity of 60% or higher:

No additional rotation.

Alternatively, the contact pressure during the abrasion process may be increased under the low temperature or low humidity environment than that under the high temperature or high humidity environment. As another alternative, the second mode may be performed at a higher frequency under the low temperature or low humidity environment as compared with under the high temperature or high humidity environment. The above operations are the process in the second mode to be performed after the end of image formation.

SECOND EXAMPLE

The aforementioned first example shows the abrasion of the photoconductive drum 2 to be performed only with the intermediate transfer belt 6. On the other hand, the second example shows the abrasion of the photoconductive drum 2 to be performed with the charge roller 3 in addition to the intermediate transfer belt 6.

Figure 7:
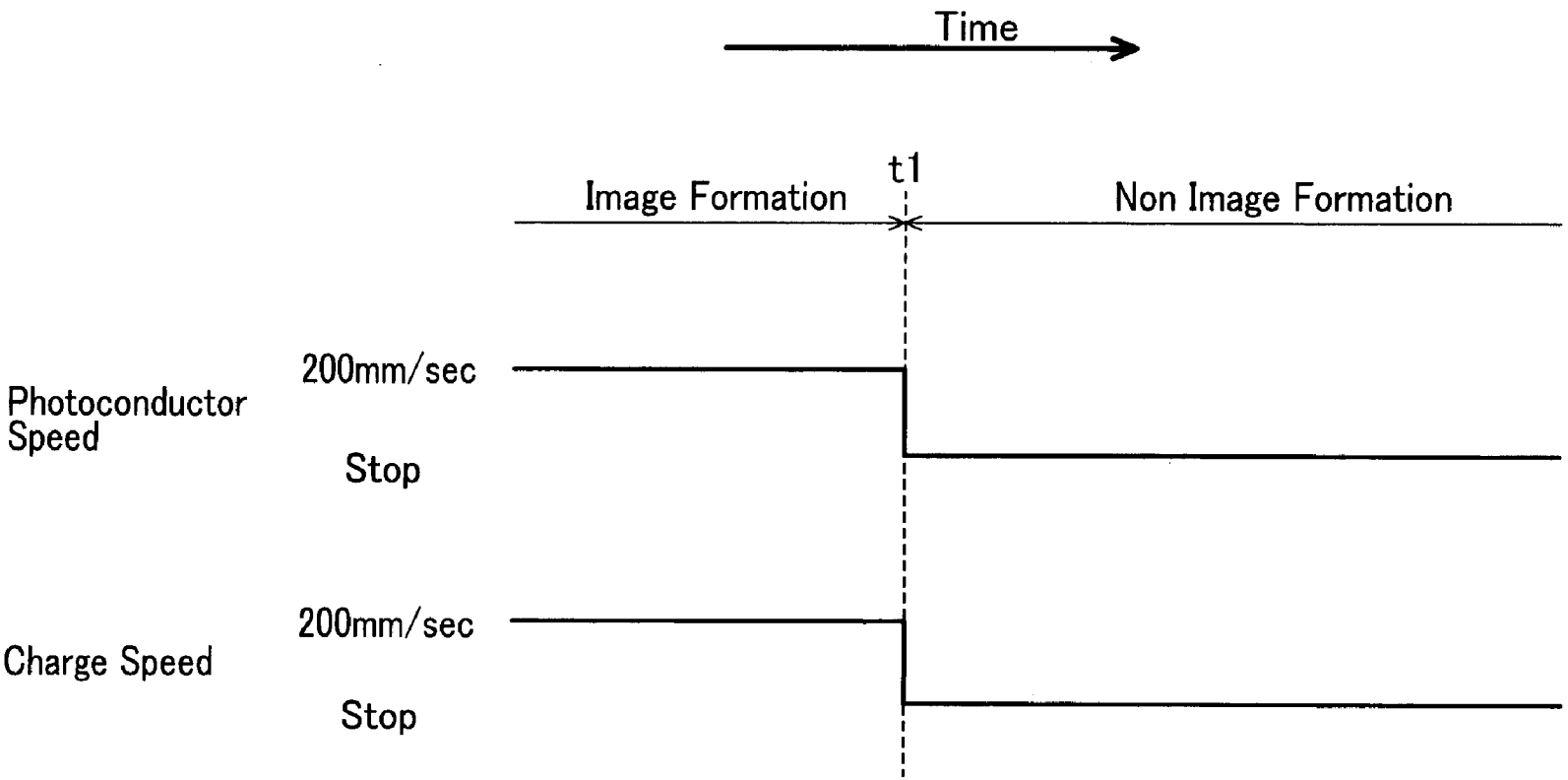
FIG. 7 is a timing chart showing control in a first mode of a second example after the end of image formation.

FIG. 7 is a timing chart showing a process in the first mode of the second example to be performed after an end of image formation. In FIG. 7, "Charge Speed" indicates the circumferential speed of the charge roller 3 during rotation (the same applies to FIG. 8). Other conditions "Photoconductor Contact", "Transfer Speed", and "Secondary Transfer" are omitted from FIG. 7 for convenience of illustration but they are the same as those in FIG. 5. In this case, "Photoconductor Contact" represents only a contact state between the photoconductive drum 2 and the intermediate transfer belt 6. The photoconductive drum 2 and the charge roller 3 remain in contact with each other without the need for separation. In FIG. 7, when the photoconductive drum 2 is stopped at time t1, the charge roller 3 is also stopped at the same time. In the first mode therefore, the photoconductive drum 2 is not abraded by the charge roller 3. It is to be noted that there is no speed difference between the charge roller 3 and the photoconductive drum 2 during image formation.

As mentioned in the first example, the photoconductive drum 2 may also be rotated continuously until the untransferred residual toner is collected. In that case, the charge roller 3 is also rotated continuously together with the photoconductive drum 2. The rotation of the charge roller 3 is not mentioned in the first example, but it is preferably operated in the same way as in the first mode of the second example.

Figure 8:
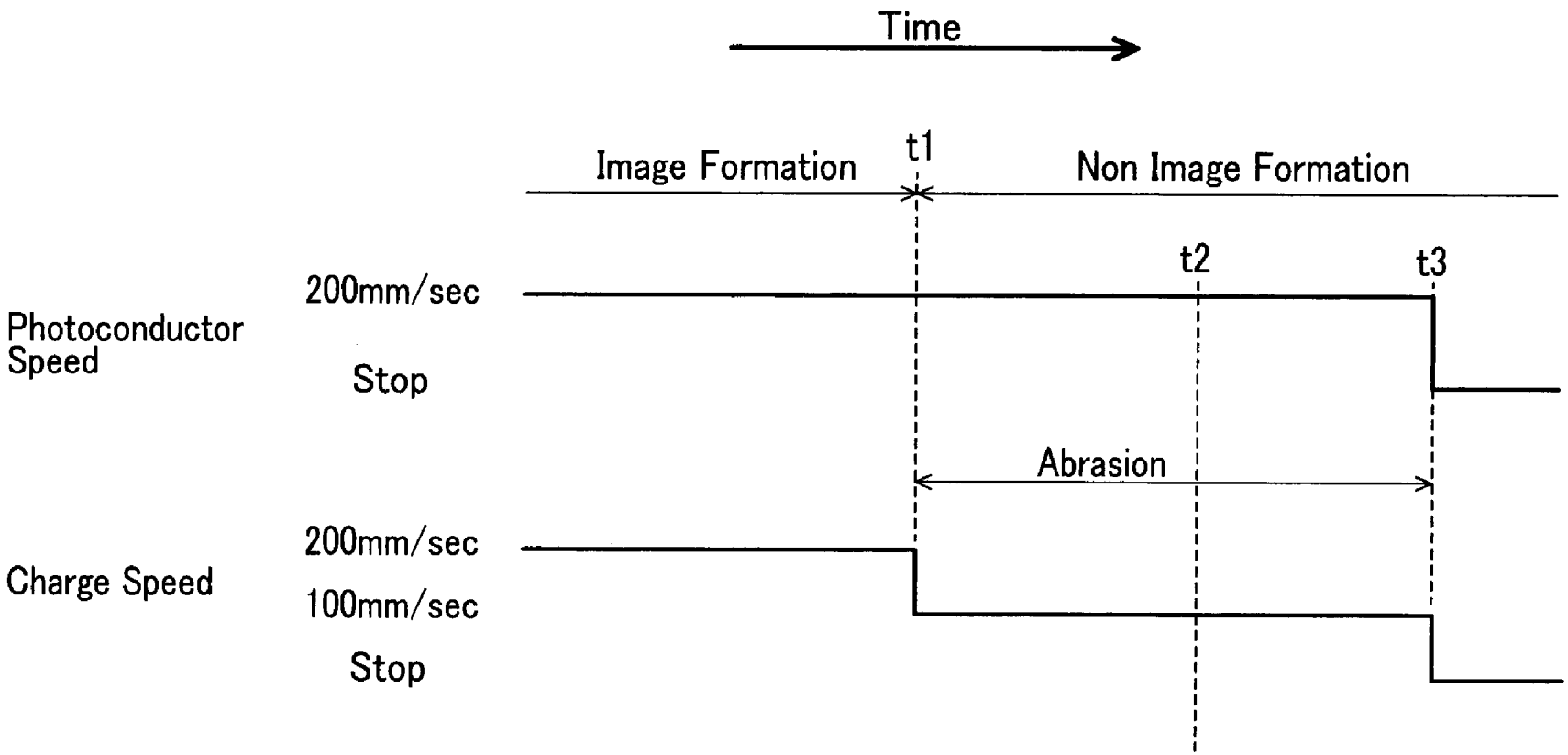
FIG. 8 is a timing chart showing control in a second mode of the second example after the end of image formation.

A second mode of the second example will be explained below referring to a timing chart in FIG. 8. As in FIG. 7, "Photoconductor Contact", "Transfer Speed", and "Secondary Transfer" are omitted from FIG. 8 for convenience of illustration but they are the same as those in FIG. 6. In FIG. 8, "Photoconductor Speed" is not stopped at time t1 but the photoconductive drum 2 continues to be rotated up to time t3. "Charge Speed" is reduced at time t1 to half the previous speed during the image formation, and then is stopped at time t3.

In the second mode of the second example, accordingly, the photoconductive drum 2 is rotated with a speed difference from the charge roller 3 for a period from time t1 to time t3. During this period, the surface of the photoconductive drum 2 is abraded, so that the deposits are removed or peeled therefrom. The thus peeled deposits are collected by the cleaning blade 5 or 10. Consequently, the surface of the photoconductive drum 2 is cleaned off, thereby enhancing the quality of an image to be formed subsequently.

For a second half period from t2 to t3 of the abrasion time from t1 to t3 by the charge roller 3, the abrasion by the intermediate transfer belt 6 explained in the first example is performed simultaneously. For a first half period from t1 to t2, the toner image remains on the belt 6. During this period, however, "Photoconductor Contact" is OFF as explained referring to FIG. 6. Accordingly, friction by the charge roller 3 will not affect the quality of an image formed just before time t1.

During the abrasion time shown in FIG. 8, as the case of FIG. 6, "Photoconductor Speed" may be reduced to produce a speed difference, instead of reducing "Charge Speed". An alternative is to increase one of "Photoconductor Speed" and "Charge Speed", instead of reducing, to produce the speed difference. During the abrasion period, contact pressure of the charge roller 3 against the photoconductive drum 2 may be adjusted to be larger than normal. This adjustment can provide higher abrasion effect. Even during the abrasion period, both the photoconductive drum 2 and the charge roller 3 are rotated. Thus, abrasion is not limited to only one portion of the photoconductive drum 2 and stress application is not limited to one portion of the charge roller 3.

Figure 9:
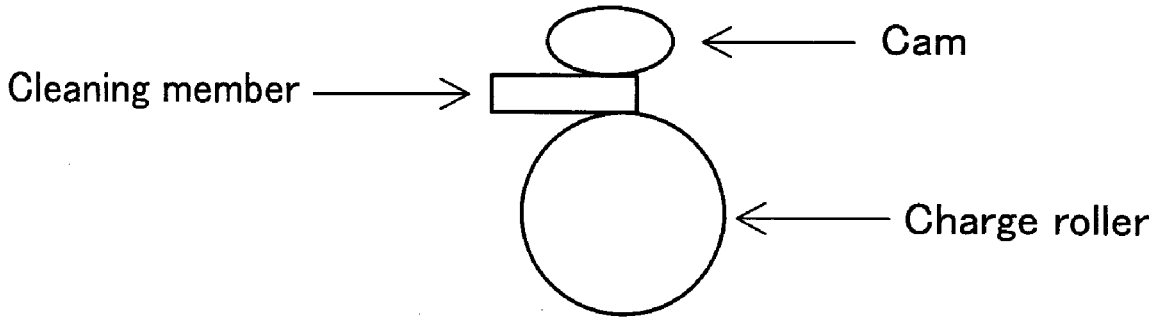
FIG. 9 is a schematic diagram showing an example of a mechanism for changing contact pressure of a charge roller.

As a means of changing the rotation speed of the charge roller 3, the roller 3 may have a dedicated power source separately from that of the photoconductive drum 2. Alternatively, the pressing pressure of a cleaning member for the charge roller 3 may be changed. As a means of changing the contact pressure of the charge roller 3, there are a manner using a pushing solenoid for pushing a shaft of the roller 3, a manner using a mechanical element such as a cam for changing the contact pressure through a cleaning member as shown in FIG. 9, and so on. By such manners, the charge roller 3 can also be separated from the photoconductive drum 2 during the non-image-formation period. In the second mode of the second example, the abrasion of the photoconductive drum 2 may also be performed by only the charge roller 3.

According to the present embodiment explained above in detail, during the non-image-formation period, the control in the first mode is executed, thereby separating the photoconductive drum 2 and the intermediated transfer belt 6 from each other. This can restrain back transfer of a coagulated matter from the belt 6 to the drum 2. Further, during the non-image-formation period, the control in the second mode is performed at an appropriate frequency, thereby abrading the surface of the photoconductive drum 2 by the belt 6 or the charge roller 3 to remove the coagulated matter adhering to the photoconductive drum 2. The above configuration can realize the image forming apparatus and the abrading method of the photoconductor thereof capable of preventing deterioration in image quality caused by adhesion of the coagulated matter such as additive components for toner to the photoconductive drum 2. In other words, the photoconductor can be refreshed appropriately without being excessively abraded, thus providing a good image quality over long term.

In the present embodiment, the abrasion of the photoconductive drum 2 is performed by use of an element conventionally existing in the image forming apparatus. Accordingly, there is no need to blend an excessive amount of abrasive as an additive component in a developer. This will cause no problems such as excessive abrasion by the additive, contamination in the apparatus, and toner charging failure. Any dedicated member for abrasion is not required, resulting in a simple structure of the apparatus. Furthermore, a large speed difference is not always provided between the photoconductive drum 2 and the intermediate transfer belt 6 and thus deterioration in image quality is not caused by an excessive speed difference.

The above embodiment is merely an example, which does not impose limitations on the present invention. The present invention therefore may be embodied in other specific forms without departing from the essential characteristics thereof. For instance, the present invention can be applied to an image forming apparatus using either a single-component type developer or a two-component type developer. The present invention is not limited to a tandem image forming apparatus or a color image forming apparatus.

In the image forming apparatus of the present invention, preferably, the first mode is normally performed to simply separate the photoconductor and the contact member even during the non image formation period and the second mode is conducted at a predetermined frequency instead of the first mode. In this second mode, the abrasion process is performed. This makes it possible to provide a good image quality without excessively abrading the photoconductor. For example, the predetermined frequency can be determined based on the number of formed images (the number of printed sheets) or the amount of toner consumption. Also at the time of occurrence of a predetermined event or matter, the second mode may be performed instead of the first mode.

The time of the abrasion process in the second mode under a low temperature or low humidity environment is preferably set to be longer than that under a high temperature or high humidity environment. This is because the toner additive components are likely to coagulate under the low temperature or low humidity environment. Alternatively, it is also preferable to extend the time of the abrasion process in the second mode as the length of use of the photoconductor gets longer, because deposit matters are apt to adhere when the photoconductor becomes fatigued. In the abrasion process in the second mode, preferably, the contact pressure between the photoconductor and the contact member is increased more than that in a normal operation, namely, an image forming operation. This configuration allows the abrasion with reliability.

In the image forming apparatus of the present invention, a typical example of the contact member is a transfer member that receives a toner image transferred from the photoconductor. Therefore, any dedicated contact member is not needed. In the case where the transfer member is an intermediate transfer body whereby secondary transfer of the toner image to a recording medium is executed, the abrasion process in the second mode is preferably performed after completion of the secondary transfer of the just now formed image so that this image be secondary transferred properly without being influenced by the abrasion.

Here, the contact pressure between the photoconductor and the contact charging member in the abrasion process is preferably increased more than that of the image formation period. It may be arranged such that the photoconductor is abraded with both the transfer member and the contact charging member in the abrasion process.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An image forming apparatus comprising a photoconductor, a toner image forming section for forming a toner image on the photoconductor, a contact member that is switchable between a contact state and a separate state with respect to the photoconductor so that the contact member contacts with the photoconductor during image formation period, and a non-image-formation-period control section that performs control to prevent contamination of a surface of the photoconductor during non image formation period, and is arranged to perform a first mode and a second mode at separate times, wherein the first mode being configured to hold the photoconductor and the contact member separate from each other during the non image formation period, and the second mode being configured to, during the non image formation period, perform an abrasion process for a predetermined time by rotating the photoconductor with a larger speed difference between the photoconductor and the contact member than that of the image formation period, while the photoconductor and the contact member are held in contact with each other, and hold the photoconductor and the contact member separate from each other for a period other than the abrasion process.

2. The image forming apparatus according to claim 1, wherein the non-image-formation-period control section is arranged to perform the first mode normally and to perform the second mode at a predetermined frequency instead of the first mode.

3. The image forming apparatus according to claim 1, wherein the non-image-formation-period control section is arranged to perform the first mode normally and to perform the second mode at the time of occurrence of a predetermined matter instead of the first mode.

4. The image forming apparatus according to claim 1, wherein the non-image-formation-period control section is arranged to extend a time of the abrasion process in the second mode under a low temperature or low humidity environment as compared with under a high temperature or high humidity environment.

5. The image forming apparatus according to claim 1, wherein the non-image-formation-period control section is arranged to extend a time of the abrasion process in the second mode as a length of use of the photoconductor gets longer.

6. The image forming apparatus according to claim 1, wherein the non-image-formation-period control section is arranged to increase contact pressure between the photoconductor and the contact member for the abrasion process in the second mode more than that in a normal operation.

7. The image forming apparatus according to claim 1, wherein the contact member is a transfer member for receiving a toner image transferred from the photoconductor.

8. The image forming apparatus according to claim 7, wherein the transfer member is an intermediate transfer body for secondary transferring the toner image to a recording medium, and the non-image-formation-period control section is arranged to perform the abrasion process in the second mode after completion of secondary transfer of a just now formed image.

9. An image forming apparatus comprising a photoconductor, a toner image forming section for forming a toner image on the photoconductor, a contact charging member for charging the photoconductor while contacting the photoconductor during image formation period, and a non-image-formation-period control section that performs control to prevent contamination of a surface of the photoconductor during non image formation period, and is arranged to, during non image formation period, perform an abrasion process for a predetermined time by rotating the photoconductor with a larger speed difference between the photoconductor and the contact charging member than that of the image formation period, while the photoconductor and the contact member are held in contact with each other.

10. The image forming apparatus according to claim 9, wherein the non-image-formation-period control section is arranged to increase contact pressure between the photoconductor and the contact charging member for the abrasion process than that during image formation period.

11. The image forming apparatus according to claim 7, wherein the apparatus further includes a contact charging member for charging the photoconductor while contacting the photoconductor during the image formation period, and wherein the non-image-formation-period control section is arranged to provide a larger speed difference between the photoconductor and the contact charging member during an abrasion process in the second mode than that of the image formation period.

12. A method of abrading a photoconductor of an image forming apparatus that comprises a photoconductor, a toner image forming section for forming a toner image on the photoconductor, and a contact member that is switchable between a contact state and a separate state relative to the photoconductor so that the contact member contacts with the photoconductor during image formation period, the method including the steps during non image formation period of:

performing an abrasion process for a predetermined time by rotating the photoconductor with a larger speed difference between the photoconductor and the contact member than that of the image formation period, with holding the photoconductor and the contact member in contact with each other, and holding the photoconductor and the contact member separate from each other for a period other than the abrasion process.

13. The abrading method of the photoconductor of the image forming apparatus according to claim 12, wherein a first mode is normally performed during the non image formation period to hold the photoconductor and the contact member separate from each other, and a second mode is performed during the non image formation at a predetermined frequency instead of the first mode, to execute the abrasion process and to hold the photoconductor and the contact member separate from each other for a period other than the abrasion process.

14. The abrading method of the photoconductor of the image forming apparatus according to claim 12, wherein a first mode is normally performed during the non image formation period to hold the photoconductor and the contact member separate from each other, and a second mode is performed during the non image formation at the time of occurrence of a predetermined matter instead of the first mode, to execute the abrasion process and to hold the photoconductor and the contact member separate from each other for a period other than the abrasion process.

15. The abrading method of the photoconductor of the image forming apparatus according to claim 12, wherein a time of the abrasion process is extended under a low temperature or low humidity environment as compared with under a high temperature or high humidity environment.

16. The abrading method of the photoconductor of the image forming apparatus according to claim 12, wherein a time of the abrasion process is extended as a length of use of the photoconductor gets longer.

17. The abrading method of the photoconductor of the image forming apparatus according to claim 12, wherein contact pressure between the photoconductor and the contact member for the abrasion process is increased than in a normal operation.

18. A method of abrading a photoconductor of an image forming apparatus that comprises a photoconductor, a toner image forming section for forming a toner image on the photoconductor, and a contact charging member for charging the photoconductor while contacting the photoconductor during image formation period, wherein during non image formation period, an abrasion process is performed for a predetermined time by rotating the photoconductor with a larger speed difference between the photoconductor and the contact charging member than that of the image formation period, with holding the photoconductor and the contact member in contact with each other.

19. The abrading method of the photoconductor of the image forming apparatus according to claim 18, wherein contact pressure between the photoconductor and the contact charging member for the abrasion process is increased than in the image formation period.

* * * * *